US012044083B1

(12) United States Patent
Quero

(10) Patent No.: US 12,044,083 B1
(45) Date of Patent: Jul. 23, 2024

(54) RISERLESS SUBSEA COILED TUBING INTERVENTION AUTOMATION

(71) Applicant: Halliburton Energy Services, Inc., Houston, TX (US)

(72) Inventor: Philippe Quero, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/207,098

(22) Filed: Jun. 7, 2023

(51) Int. Cl.
*E21B 19/22* (2006.01)
*E21B 33/076* (2006.01)

(52) U.S. Cl.
CPC ..... *E21B 19/22* (2013.01); *E21B 33/076* (2013.01)

(58) Field of Classification Search
CPC ..... E21B 19/22; E21B 33/076
See application file for complete search history.

(56) References Cited

U.S. PATENT DOCUMENTS 6,116,345 A 9/2000 Fontana et al.
7,431,092 B2 * 10/2008 Haheim ..... E21B 33/076 166/85.1
7,984,765 B2 * 7/2011 Askeland ..... E21B 34/06 166/347
8,720,582 B2 * 5/2014 Portman ..... E21B 19/22 166/344
9,347,294 B2 * 5/2016 Gramstad ..... E21B 19/002
9,822,613 B2 11/2017 Crawford et al.
2004/0124008 A1 7/2004 Fincher et al.
2012/0193104 A1 * 8/2012 Hoffman ..... E21B 33/035 166/348
2013/0284434 A1 10/2013 Marvel

OTHER PUBLICATIONS

International Search Report and Written Opinion for International Patent Application No. PCT/US2023/027448 dated Feb. 27, 2024. PDF file. 13 pages.

* cited by examiner

*Primary Examiner* — Matthew R Buck
(74) *Attorney, Agent, or Firm* — Thomas Rooney; C. Tumey Law Group PLLC

(57) ABSTRACT

A method may include positioning a vessel supporting a coiled tubing string over a subsea wellhead disposed on a wellbore; relaying and landing a distal end of the coiled tubing string to the subsea wellhead using a first injector, wherein relaying the distal end of the coiled tubing string may include relating a second injector into a subsea environment to establish a subsea injector, and wherein the first injector is a surface injector disposed on the vessel. The method may further include connecting a coiled tubing module to a pressure control assembly disposed on a subsea wellhead and using either the first injector or the second injector as a principal injector to extend the coiled tubing string into the wellbore, wherein the principal injector is determined based at least in part on a wellbore pressure. The method may further include performing a wellbore operation with the coiled tubing string, wherein the wellbore operation does not utilize a riser.

20 Claims, 4 Drawing Sheets

RISERLESS SUBSEA COILED TUBING INTERVENTION AUTOMATION

BACKGROUND

Coiled tubing may be used to perform a variety of wellbore service operations to improve, cease, or maintain the operational performance of wellbores used to produce fluids from or inject fluids into a subterranean formation. Since coiled tubing operations utilize a continuous tubing string, performing wellbore service operations using coiled tubing may require less time than using stick-pipe. For example, rigs which use stick-pipe must stop periodically to make up or break connections when running tools or tubulars into and/or out of the wellbore. The time savings realized by utilizing by a coiled tubing operation may be particularly useful for deeper wellbores, longer wellbores, and/or subsea wellbores. In some examples, coiled tubing operations allow for the continuous circulation of fluids utilized during wellbore operations. For example, coiled tubing operations may be able to continuously circulate fluids during operations which simultaneously extend or retract the coiled tubing string in the wellbore. Additionally, coiled tubing operations may be beneficial for wellbore operations which utilize energized fluids such as fluids foamed with nitrogen or carbon dioxide. During coiled tubing operations, the coiled tubing string is typically run into and/or pulled out of the wellbore using a device referred to as an injector. When running in hole ("RIH") or tripping in hole ("TIH"), the injector feeds the coiled tubing into the wellbore and the coiled tubing may be unspooled from the coiled tubing spool. When tripping out of hole ("TOOH") or pulling out of hole ("POOH"), the injector withdraws coiled tubing out of the wellbore and the coiled tubing is rolled onto or spooled back onto the coiled tubing spool.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
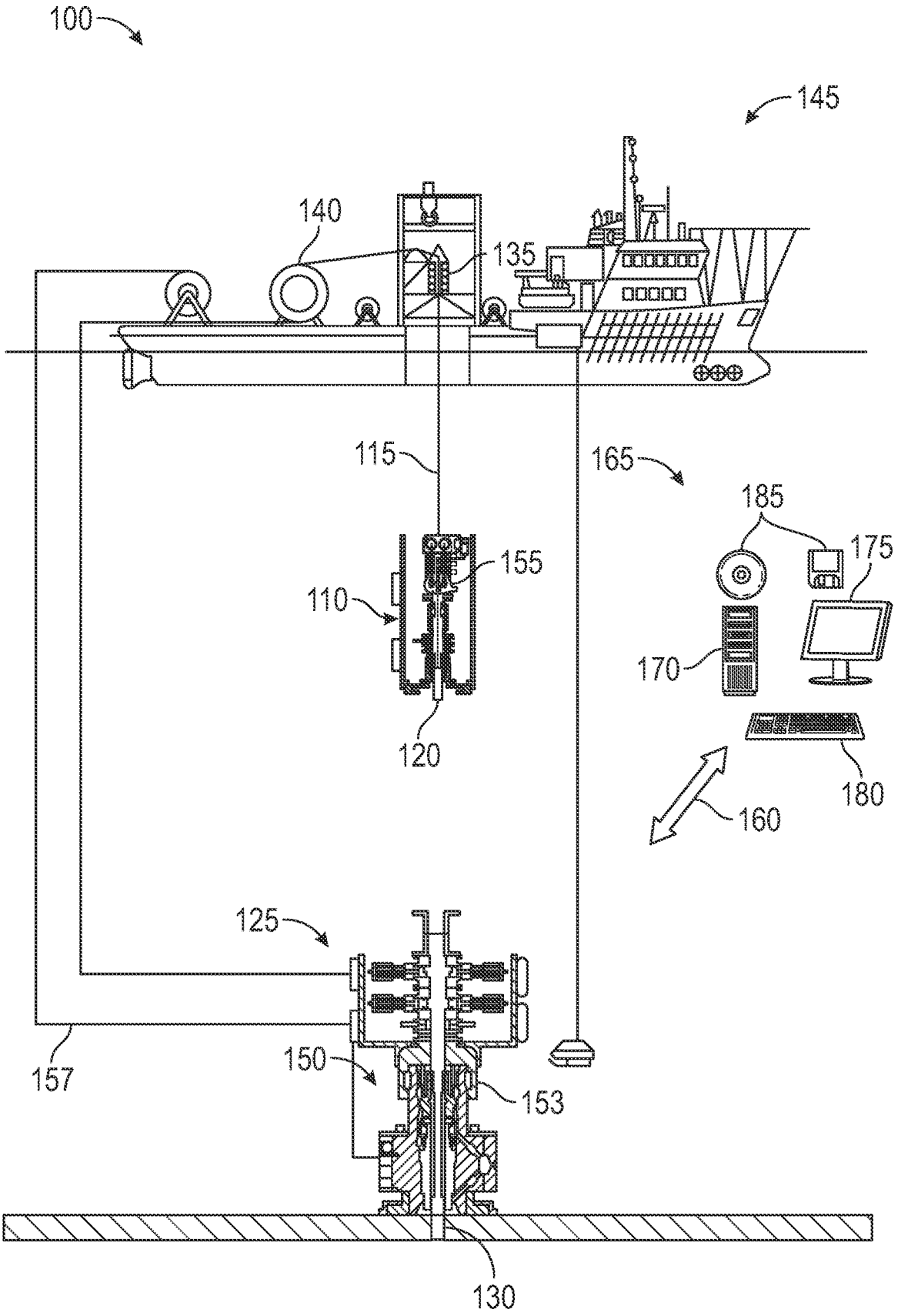
FIG. 1 illustrates a portion of coiled tubing operation including a deployment of a coiled tubing module into a subsea environment on a coiled tubing string.

A method and a system for performing operations and/or servicing subsea or sub-aquatic wellbores using a riserless coiled wellbore operation is disclosed. A riser may be a conduit which is disposed between a vessel which hosts at least a coiled tubing string and a subsea or sub-aquatic wellhead, where a portion of the coiled tubing string may be disposed within the riser to allow for circulation of wellbore treatment fluids from the vessel to the wellbore and back to the vessel. In riseless operations, the coiled tubing string disposed between the vessel and the wellhead may be exposed to the open subsea environment. For subsea coiled tubing operations, a coiled tubing string may be disposed on a coiled tubing reel which may be disposed on a vessel. The vessel may include any type of equipment which may support a coiled tubing operation in an aquatic environment including but not limited to barges, semi-submersible equipment, fully submersible equipment, and rigs. The vessel may be navigated over a subsea wellhead such that the coiled tubing string may be relayed into a subsea wellbore (or "wellbore") on which the subsea wellhead is disposed. One or more injectors may be used to manipulate the coil tubing string which may include extending or retracting a portion of the coiled tubing string into and/or out of the subsea environment and/or the wellbore. The injectors may have opposing chain loops including grippers which may be operable to grip and longitudinally displace (e.g., unspool) and/or reel in (e.g., spool) the coiled tubing string from the coiled tubing reel. In some examples, a snubbing jack or a snubbing unit may replace the injector to provide the thrust required to insert or extract the coiled tubing string into and out of the wellbore. In some examples, coiled tubing operations performed on subsea wellbores may include two or more injectors to execute the operations, where a first injector may be located on the vessel and a second injector may be located in the subsea environment. The injector located on the vessel may be referred to as the vessel injector or the surface injector, while the injector located in the subsea environment may be referred to as the subsea injector. In some examples, the surface injector may be replaced with a snubbing unit and/or snubbing jack, which may function to insert or remove the coiled tubing string from the wellbore. The subsea injector may operate in combination with a stripper to form a seal around the outer diameter of the coiled tubing string. The pressure applied by the stripper to form the seal around the coiled tubing string may be a function of the pressure exerted by the overbearing water column from the subsea environment and the pressure of the fluid in the wellbore. In other words, the stripper may function to prevent fluids from the wellbore from leaking into the subsea environment while also preventing fluids from the subsea environment from entering the wellbore. As such, the stripper may function even when the chain loops of the injector are not engaged with the coiled tubing string.

In some examples, wellbore operations may be performed on live wells which may require the implementation of certain protocols to execute the operation safely and effectively. For example, the pressure of the fluid in the subterranean formation (e.g., exerted in an upward direction) may be greater than the downward exerted pressure of the fluid column in the wellbore (e.g., hydrostatic head). In the foregoing example, when the wellbore is unrestricted (e.g., a pressure barrier and/or choke is not engaged in a way that fully restricts fluid flow), the wellbore may conduct fluid to and past the location of the wellhead (e.g., the wellbore may flow). In some examples, this scenario may be referred to as a "live well," which is to say, the well is capable of flowing or producing fluid from the pressure in the subterranean formation. In other examples, the downward pressure exerted by the fluid column in the wellbore (e.g., hydrostatic head) may be greater than or equal to the pressure exerted by the fluid in the subterranean formation such that the well does not flow. This may be referred to as a "dead well."

When wellbore operations, such as coiled tubing operations, are performed on live wells, the operations may include scenarios where the coiled tubing string is "pipe light." In some examples, a coiled tubing string may be considered "pipe light," when the upward force exerted by the fluid in a wellbore (e.g., a live well condition) is great enough to push the coiled tubing string out of the wellbore when the coiled tubing string is freely hanging. For example, a blow-out may be an event where pressure control is lost during a wellbore operation and the upward force of the fluid in the wellbore may eject a work string, such as a coiled tubing string, from the wellbore. Alternatively, in some examples, a coiled tubing string may be considered "pipe heavy," when a downward force (e.g., weight) of the coiled tubing string is greater than an upward force exerted by the fluid in the wellbore when the coiled tubing string is freely hanging. In some examples, additional pieces of equipment including snubbing units, hydraulic workover units, and snubbing jacks may work separately or in combination with the injectors to execute wellbore operations when the coiled tubing string is "pipe light." In some examples, coordinating the operations of the two or more injectors included in a subsea coiled tubing operation may include operating within a safety protocol which may account for whether the coiled tubing string is pipe heavy or pipe light.

As previously described, subsea coiled tubing operations may include two injectors, where a first injector may be located on the vessel and a second injector may be located in the subsea environment. In some examples, the operations of the two or more injectors may be coordinated to establish and/or maintain a coiled tubing operational parameter and/or a coiled tubing operational parameter envelope while adhering to the aforementioned safety protocol. In some examples the coiled tubing operational parameter or coiled tubing operational parameter envelope may be a tension or tension envelope established between the two or more injectors. In other examples, the coiled tubing operational parameter or coiled tubing operational parameter envelope may be a distance or distance envelope established between the two or more injectors.

During coiled tubing operations that include two or more injectors, it may be beneficial to have a method to coordinate the operations of the two or more injectors in order to adhere to the safety protocol while establishing and maintaining the coiled tubing operational parameter or coiled tubing operational parameter envelope. In some examples, since the two or more injectors may both manipulate the coiled tubing string, a lack of coordination in the operations of the two injectors may cause damage or fatigue to the coiled tubing string. As such, it may be beneficial to identify and assign one of the injectors as a principal injector, where the principal injector controls the wellbore operation in a given scenario. Once a principal injector is assigned or determined for a given scenario, any other injector involved in the wellbore operation may be considered an agent injector. In some examples, coordinating operations between the principal injector and the agent injector may include allowing the principal injector to lead the execution of the operation while the agent injector follows the principal injector. For example, a principal injector may directly control the location of a bottom hole assembly ("BHA") disposed on the distal end of a coiled tubing string which may further be disposed in a wellbore. In some examples, a drive system to the chain loops of the agent injector may be at least partially or fully disengaged from the coiled tubing string. As such, for some examples, the pressure applied on the coiled tubing by the chain loops of the agent injector may be reduced or removed. In further examples, maintaining the pressure on the coiled tubing string with the chains of the principal injector while reducing or removing the pressure of the coiled tubing string from the chains of the agent injector may reduce the amount of wear and/or fatigue on the coiled tubing string. In further examples, the reduction or removal of the pressure from the chains of the agent injector may reduce the energy consumption required to perform the operation.

In some examples, the principal injector may also be referred to as the primary injector or the controller injector. In further examples, the agent injector may be referred to as the secondary injector, the worker injector, or the replica injector. The designation of the principal injector between the two or more injectors may vary throughout a wellbore operation depending on the scenario. For example, in certain scenarios during a wellbore operation, the first injector (e.g., the injector located on the vessel) may be designated as the principal injector. In other scenarios which may arise during the same wellbore operation, the second injector (e.g., the subsea injector), or an injector other than the first injector may be designated as the principal injector. In some examples, the categorization of various scenarios may include consideration for the operation being performed, the conditions the operation is being performed in (e.g., pipe heavy and/or pipe light), and combinations thereof. As such, both the first injector (e.g., the injector located on the vessel) or the second injector (e.g., the subsea injector) may be the principal injector at some point during a wellbore operation as determined by the scenarios encountered during the wellbore operation. For example, the first injector may be the principal injector when the coiled tubing string is not disposed within the wellbore and is being relayed to and from the subsea wellhead. As previously mentioned, in some examples, the injector located on the vessel may be a snubbing unit, hydraulic workover unit, or a snubbing jack.

In some examples, an automated or semi-automated workflow may be used to determine the injector which may be assigned as the preferred principal injector. For example, an information handling system may be configured to automatically assign the task of principal injector without the need for human intervention. In other examples, a human may oversee which injector is designated as the principal injector. The workflow which may determine the assignment of the principal injector and the agent injector is provided in more detail below.

Figure 2:
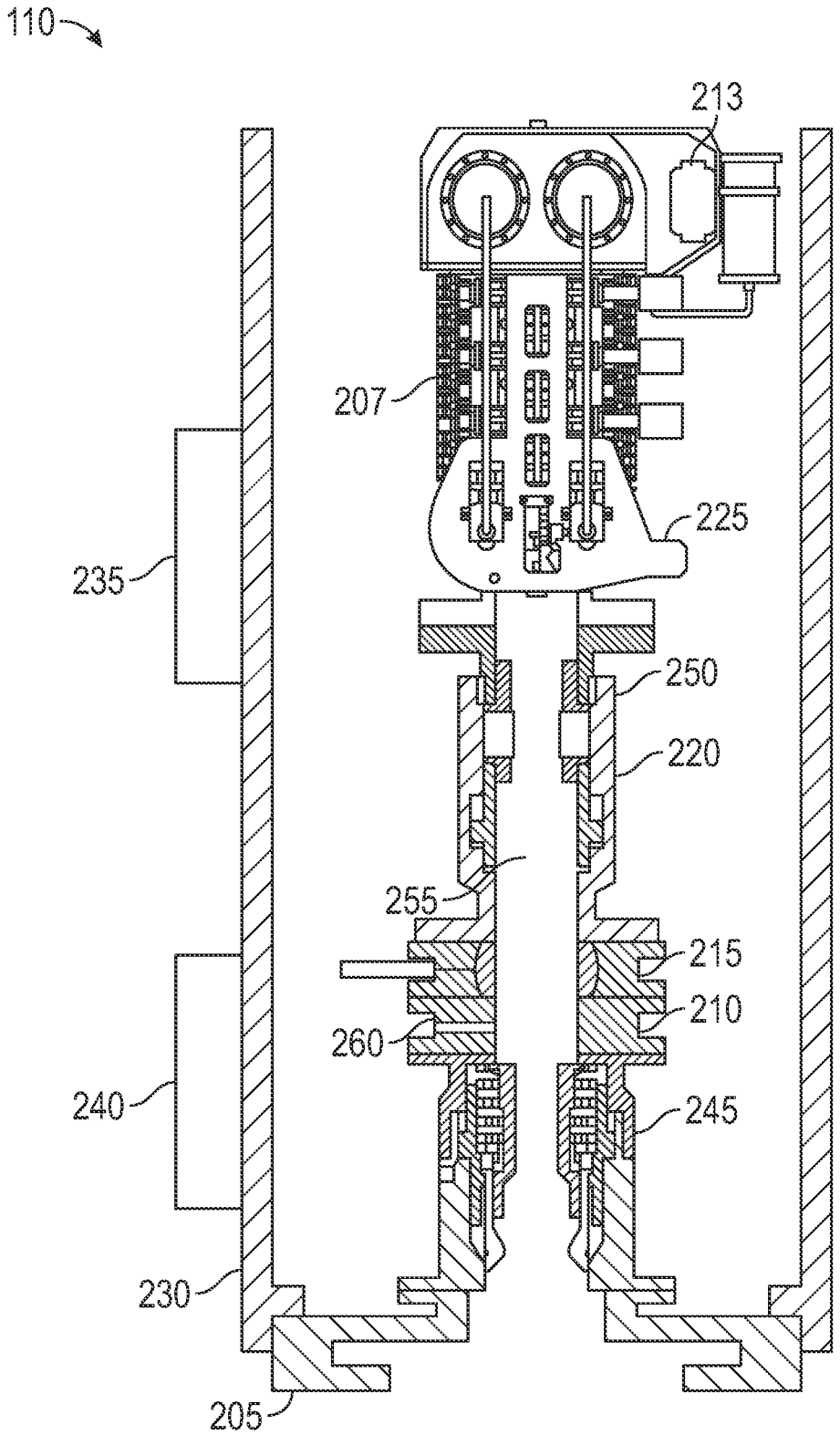
FIG. 2 illustrates some components of a coiled tubing module.

FIG. 1 illustrates a portion of coiled tubing operation 100 including a deployment of the coiled tubing module 110 into the subsea environment on a coiled tubing string 115. As depicted in FIG. 2, coiled tubing module 110 may include a coiled tubing adaptor 205, chain loops 207, a fluid sub 210, a drive motor 213 (e.g., which may be hydraulic or electric), an isolation valve 215, a stripper 220, a subsea coiled tubing injector 225 ("subsea injector"), a frame 230, a control relay 235, an interface 240, such as a junction plate, and a tool catcher 245. Coiled tubing module 110 may additionally include one or more sensors 250 which may further collect measurements related to the coiled tubing operation. In some examples the one or more sensors may include load cells and/or strain gauges to measure tension and/or compression in the coiled tubing string (e.g., coiled tubing string 115 of FIG. 1), distance measurement devices such as encoders and/or lasers to track the amount of coiled tubing string that has been spooled or unspooled, and/or pressure measurement devices. The sensors may be located anywhere on coiled tubing module including on the chain loops, on a portion of coiled tubing module disposed below stripper 220, and/or on drive motor 213. In some examples, two or more of the same type of sensor may be used to take measurements. In further examples, the measurements may be used as an average or a weighted average. In some examples, when drive motor 213 is an electric drive motor, the current measured from the drive motor may be used to determine a weight of the coiled tubing string (e.g., coiled tubing string 115 in FIG. 1) disposed below subsea coiled tubing injector 225. In other examples, pressure measurements taken from chain loops 207 may be used to determine a weight of the coiled tubing string disposed below subsea coiled tubing injector 225. Coiled tubing adaptor 205, fluid sub 210, isolation valve 215, stripper 220, and tool catcher 245 may each include a housing or body having a longitudinal bore therethrough and be connected, such as by flanges, such that a continuous bore is maintained therethrough. However, in some examples, the coiled tubing module may not include tool catcher 245, isolation valve 215, or fluid sub 210. In further examples, coiled tubing adaptor 205 may be disposed adjacent to and beneath stripper 220 such that coiled tubing adaptor 205 abuts stripper 220. In such examples, there may be a profile disposed on an inner conduit or bore 255 of coiled tubing module 110. The profile may be a no-go profile which prevents a BHA (as described in further detail below) from progressing past the no-go profile. Frame 230 may be fastened to coiled tubing adaptor 205. Relay 235 and interface 240 may be fastened to frame 230. Fluid sub 210 may include a housing having a bore therethrough and a port 250 in communication with the bore. Port 260 may be in fluid communication with interface 240 via a conduit (not shown).

Referring back to FIG. 1 the deployment of coiled tubing module 110 may also include deploying or relaying a bottom home assembly ("BHA") 120, wherein BHA 120 is disposed on beneath coiled tubing module 110 on the coiled tubing string 115. Once deployed, coiled tubing module 110 may connect into a pressure control assembly 125. In some examples the pressure control assembly 125 may include a blowout preventor which may further include multiple sets or stacks of rams capable of maintaining wellbore pressure control of a subterranean wellbore 130. Coiled tubing string 115 may be deployed using surface injector 135 and coiled tubing reel 140, both of which may be disposed on vessel 145. Surface injector 135 may include a head for driving coiled tubing string 115, controls, and a power unit. The power unit for the surface injector may be electric or hydraulic. Additionally, the power unit for the subsea injector 155 may be hydraulic or electric. Furthermore, in some examples, surface injector 135 may include the same or substantially similar sensors as described above in FIG. 2 for coiled tubing module 110. For example, one or more sensors may be disposed on surface injector 135 including load cells and/or strain gauges to measure tension and/or compression in coiled tubing string 115, distance measurement devices such as encoders and/or lasers to track the length of coiled tubing which may be spooled and/or unspooled, and/or pressure measurement devices. The sensors may be located anywhere on surface injector 135. In some examples, when a drive motor of surface injector 135 is an electric motor, the current measured from the drive motor may be used to determine a weight of coiled tubing string 115 disposed below surface injector 135. In other examples, pressure measurements taken from the chain loops of surface injector 135 may be used to determine a weight of coiled tubing string 115 disposed below surface injector 135. Coiled tubing string 115 may be inserted through the coiled tubing module 110 and connected to BHA 120. BHA 120 may include one or more tools operable to perform a wellbore operation or abandonment operation in a subterranean wellbore. Pressure control assembly 125 may be installed on wellhead 150 which may further be disposed on a subterranean wellbore 130. In some examples, wellhead 150 may include one or more sensors 153. For example, sensor 153 may include one or more pressure and/or temperature sensors. Coiled tubing module 110 may include a subsea injector 155 which may be deployed over a moon pool disposed in vessel 145 or over a side of vessel 145 and the coiled tubing module 110 may be lowered to pressure control assembly 125 using the surface injector 135 and coiled tubing string 115. In some examples umbilical cable 157 may include a communication link 160 which may connect an interface (e.g., interface 240 from FIG. 2) to an information handling system 165. However, communication link 160 may be a wireless telemetry system which utilizes acoustic energy to transmit signals to information handling system 165.

Any suitable technique may be used for transmitting signals from sensors disposed on wellhead 150, coiled tubing module 110, surface injector 135 to instrumentation and/or computational systems on vessel 145. In some examples, the sensors disposed on the wellhead, coiled tubing module, and/or the surface injector may include pressure sensors, strain sensors, tension sensors, weight sensors, and motion sensors such as encoders. As illustrated, a communication link 160 (which may be wired or wireless, for example) may be provided that may transmit data from sensors disposed on wellhead 150, coiled tubing module 110, and/or surface injector 135 to a computational system such as information handling system 165. As previously mentioned, umbilical cable 157 may include communication link 160 which connects an interface (e.g., interface 240 from FIG. 2) to relay information from coiled tubing module 110 to information handling system 165. However, communication link 160 may be a wireless telemetry system which utilizes acoustic energy to transmit information in the form of signals from coiled tubing module 110 or wellhead 150 to information handling system 165. Information handling system 165 may include a processing unit 170, a monitor 175, an input device 180 (e.g., keyboard, mouse, etc.), and/or computer media 185 (e.g., optical disks, magnetic disks) that can store code and control logic representative of the methods described herein. The information handling system 165 may act as a data acquisition system and possibly a data processing system that analyzes information from a coiled tubing operation. For example, information handling system 165 may process the information from the tools and devices (e.g., injectors and wellhead sensors) included in a coiled tubing operation. The information handling system 165 may also utilize measurements gathered from sensors disposed on the injectors and wellhead in conjunction with control logic to determine and designate the principal injector and agent injector. This processing may occur on vessel 145 in real-time. Alternatively, the processing may occur in the subsea environment on an information handling system 165 disposed on coiled tubing module 110.

Figure 3:
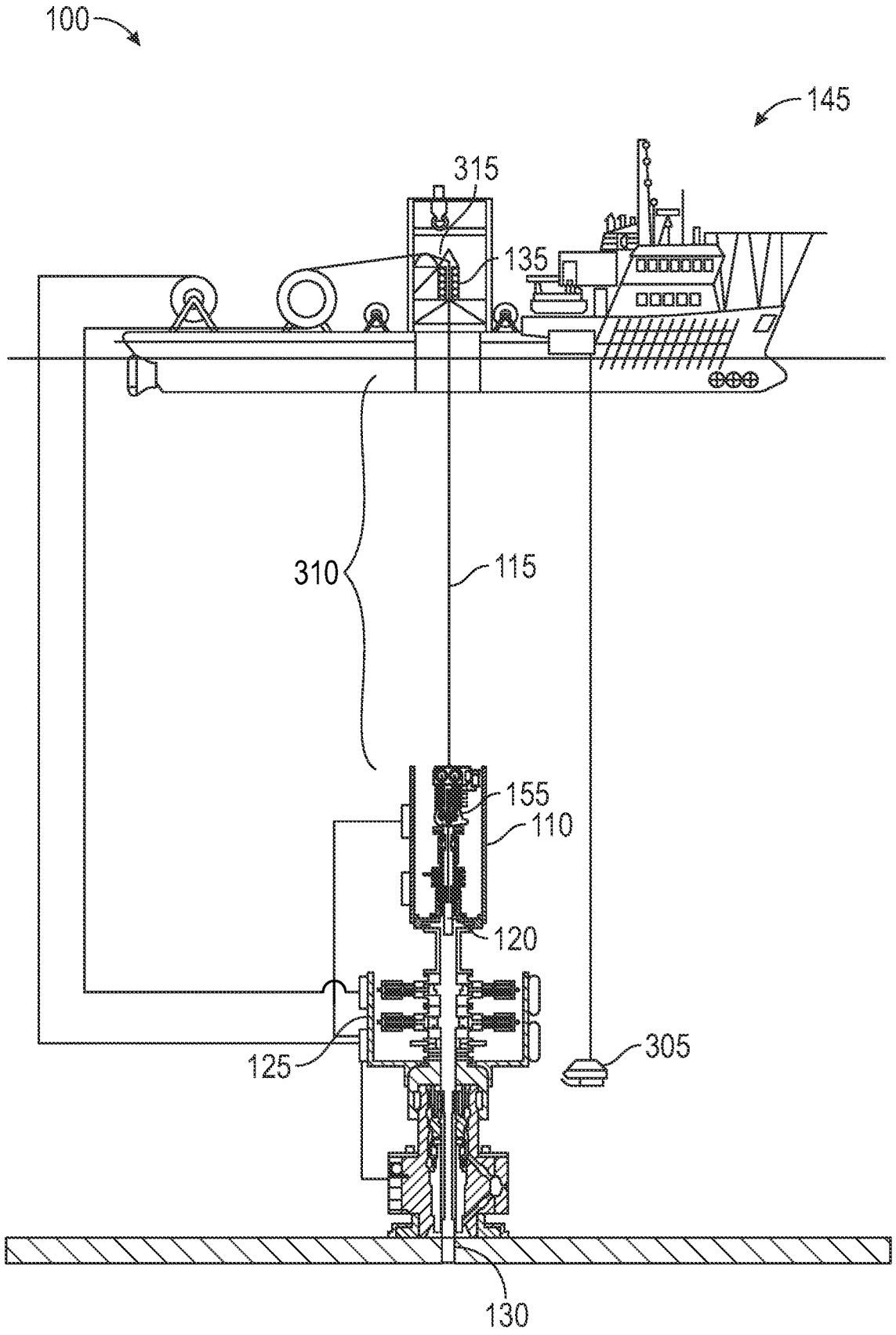
FIG. 3 illustrates another portion of a coiled tubing operation including performing operations using a coiled tubing string and a bottom hole assembly in a subterranean wellbore.

FIG. 3 illustrates another portion of coiled tubing operation 100 including performing operations using coiled tubing string 115 and BHA 120 in wellbore 130. Once a coiled tubing adaptor (e.g., coiled tubing adaptor 205 in FIG. 2), which may be a component of coiled tubing module 110, has landed onto pressure control assembly 125, a remotely operated vehicle ("ROV") 305 may operate coiled tubing adaptor (e.g., coiled tubing adaptor 205 in FIG. 2), thereby fastening coiled tubing module 110 to pressure control assembly 125. Once coiled tubing adaptor (e.g., coiled tubing adaptor 205 in FIG. 2) is fastened to pressure control assembly 125, a coiled tubing operational parameter or coiled tubing operational parameter envelope 310 may be established between surface injector 135 and subsea injector 155 (e.g., subsea injector 225 in FIG. 2). In some examples the coiled tubing operational parameter or coiled tubing operational parameter envelope 310 may be a tension or tension envelope established between surface injector 135 and subsea injector 155. When the coiled tubing operational parameter is a tension, the surface injector 135 and subsea injector 155 may work in coordination to maintain an established tension in the portion of coiled tubing string 115 disposed between surface injector 135 and subsea injector 155. When the coiled tubing operational parameter is a tension envelope, the surface injector 135 and subsea injector 155 may work in coordination to maintain an established range of tensions in the portion of coiled tubing string 115 disposed between surface injector 135 and subsea injector 155. In other examples, the coiled tubing operational parameter or coiled tubing operational parameter envelope 310 may be a distance or distance envelope may be established between surface injector 135 and subsea injector 155. When the coiled tubing operational parameter is a distance, the surface injector 135 and subsea injector 155 may work in coordination to maintain an established length of coiled tubing string 115 disposed between surface injector 135 and subsea injector 155. When the coiled tubing operational parameter is a distance envelope, the surface injector 135 and subsea injector 155 may work in coordination to maintain an established range of lengths of coiled tubing string 115 disposed between surface injector 135 and subsea injector 155. In addition to the coordination of surface injector 135 and subsea injector 155, a heave compensator 315 disposed on vessel 145 may serve to compensate for heave of the vessel 145. In some examples, heave compensator 315 is a passive heave compensator. If further examples, heave compensator 315, which may be a passive heave compensator, may further be disposed above the surface injector 135. The heave compensator 315 may at least partially allow for coiled tubing operational parameter or coiled tubing operational parameter envelope 310 to be maintained despite undulations experienced by vessel 145 due to movement in the body of water in which vessel 145 is disposed.

Once coiled tubing operational parameter or coiled tubing operational parameter envelope 310 is established, a stripper (e.g., stripper 220 in FIG. 2), which may be operable to seal against coiled tubing string 115 may be engaged with coiled tubing string 115 by the vessel operator. In some examples, the stripper (e.g., stripper 220 in FIG. 2) may be engaged to seal against coiled tubing string 115 for the duration of the coiled tubing operation. Once the stripper is sealed against coiled tubing string 115, additional isolation devices which were previously sealed to maintain wellbore isolation may be opened and BHA 120 may be released from the tool catcher (e.g., tool catcher 245 in FIG. 2). A drive motor of subsea injector 155 may then be operated by the vessel operator, thereby advancing BHA 120 toward subterranean wellbore 130. The coiled tubing operational parameter or coiled tubing operational parameter envelope 310 may be maintained through synchronization of surface injector 135 and subsea injector 155 by communication with a controller including control logic which may further be disposed on an information handling system (e.g., information handling system 165 of FIG. 1). The control logic which may be run on the information handling system will be further described below. The coiled tubing string 115 may be advanced (while maintaining coiled tubing operational parameter or coiled tubing operational parameter envelope 310 via synchronous operation of surface injector 135) into the wellbore 130 by the subsea injector 155 until the BHA 120 reaches a desired depth in wellbore 130. The one or more intervention and/or abandonment operations may then be conducted using coiled tubing string 115 and BHA 120. In some examples, and to facilitate the intervention or abandonment operation, fluid may be pumped through coiled tubing string 115 and BHA 120 and returned to vessel 145 via a port (e.g., port 260 in FIG. 2). Further, fluid may be pumped into the wellbore 130 before or after deployment of BHA 120 through the port with an isolation valve (e.g., isolation valve 215 in FIG. 2) closed, thereby protecting a BOP stack in pressure control assembly 125 from the fluid.

Once the intervention or abandonment operation has concluded, BHA 120 and coiled tubing string 115 may be retrieved from wellbore 130 by reversing the drive motor (e.g., drive motor 213 in FIG. 2) on subsea injector 155 (while maintaining coiled tubing operational parameter or coiled tubing operational parameter envelope 310 via synchronous operation of surface injector 135) until BHA 120 engages the tool catcher (e.g., tool catcher 245 of FIG. 2). The isolation valve (e.g., isolation valve 215 in FIG. 2) may then be closed by the vessel operator. Once wellbore 130 is pressure isolated and secured, and BHA 120 is removed from well 130, the coiled tubing operational parameter or coiled tubing operational parameter envelope 310 may be relaxed by surface injector 135. ROV 305 may disconnect the coiled tubing adaptor connection and coiled tubing module 110 may be retrieved from the subsea environment using surface injector 135.

Figure 4:
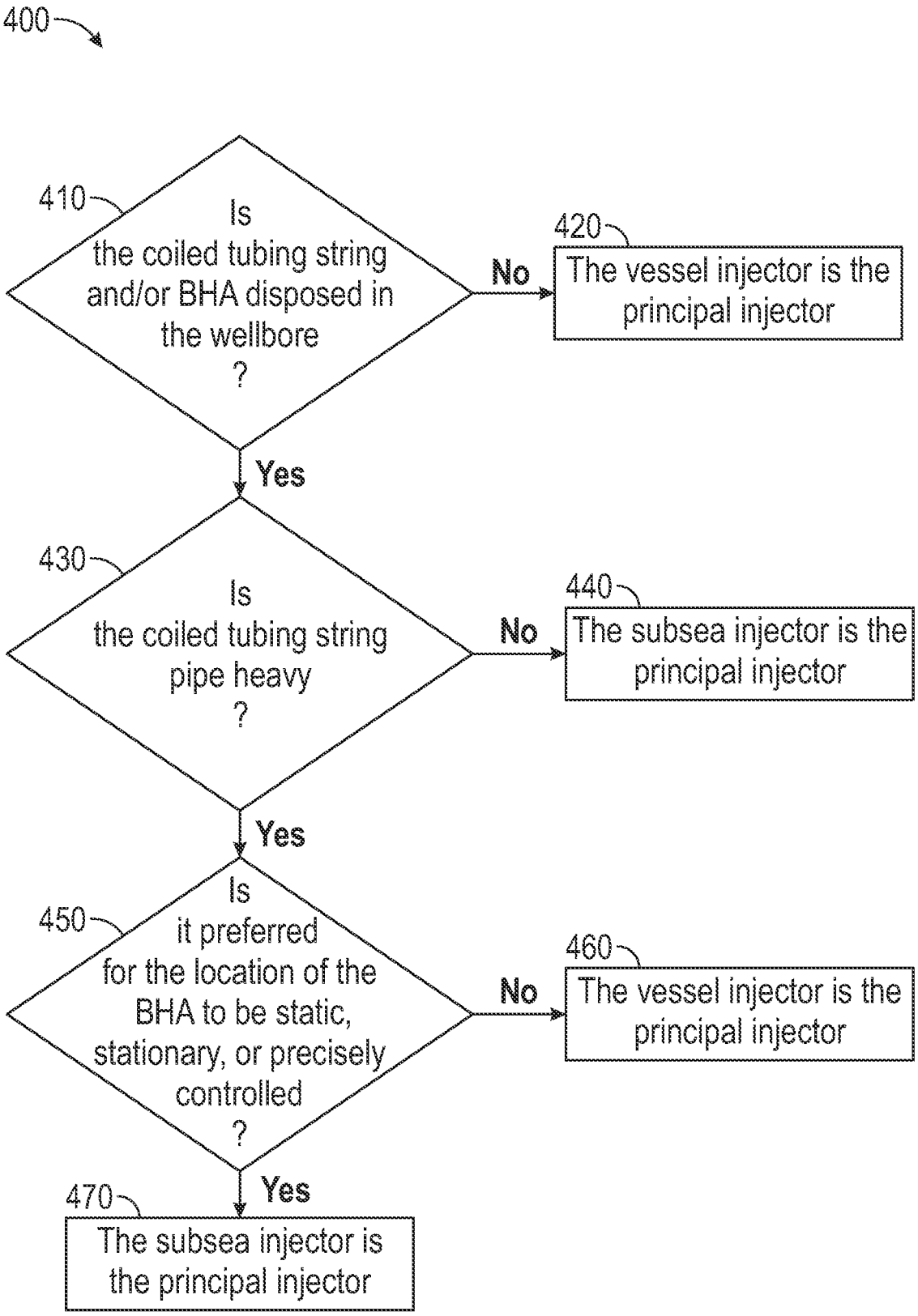
FIG. 4. illustrates a flow chart for selecting a principal injector.

FIG. 4 illustrates a flow chart 400 for selecting a principal injector from the two or more injectors. Flow chart 400 may provide control logic which may be implemented by an information handling system as described herein. Flow chart 400 may start in block 410 where it is determined whether the coiled tubing string (e.g., coiled tubing string 115 in FIG. 1) or the BHA (e.g., BHA 120 in FIG. 1) is disposed in the wellbore (e.g., subterranean wellbore 130 in FIG. 1). For example, if the coiled tubing string is relaying the BHA to or from the subsea wellhead (e.g., subsea wellhead 150 in FIG. 1) then the BHA and coiled tubing string may not be disposed in the wellbore. In further examples, if the coiled tubing adaptor (e.g., coiled tubing adaptor 205 in FIG. 2) is not connected to the pressure control assembly (e.g., pressure control assembly 125 in FIG. 1), then the BHA and coiled tubing string may not be disposed in the wellbore. If is it determined in block 410 that the coiled tubing string and/or BHA is not disposed in the wellbore, then the flow chart proceeds to block 420 and the surface injector (e.g., surface injector 135 in FIG. 1) is the principal injector. In such examples, the surface injector may continue to operate and function to feed the coiled tubing string or the BHA toward the wellbore. If it is determined in block 410 that the coiled tubing string and/or BHA is disposed in the wellbore, then the flow chart proceeds to block 430.

In block 430 it is determined whether the coiled tubing string is categorized as pipe heavy or pipe light. As previously described, the determination of whether the coiled tubing string is pipe heavy or pipe light may include factors such as the well pressure and the weight of the coiled tubing string disposed in the well. If it is determined in block 430 that the coiled tubing string is pipe light, then flow chart 400 proceeds to block 440 and the subsea injector (e.g., subsea injector 155 in FIG. 1) is the principal injector. In such examples, the subsea injector may continue to operate and function to feed the coiled tubing string or the BHA toward the wellbore. If it is determined in block 430 that the coiled tubing string is pipe heavy, then flow chart 400 proceeds to block 450.

In block 450 it is determined whether the manipulation of the coiled tubing string and/or the location of the BHA utilizes depth control and/or if the BHA should be maintained in a static or stationary position. In some examples, maintaining precise depth control of the BHA may be an operational parameter during wellbore operations in which the BHA is disposed in a specific location to perform an operation. In some non-limiting examples, this may include perforation operations, operations where a tool on the BHA may be used to manipulate another piece of equipment disposed in the wellbore at a certain location, operations where chemicals pumped into the wellbore through the coiled tubing are preferred to be placed at a specific location, or logging operations where a specific zone of interest in the wellbore is to be logged using a logging device which may be a component of the BHA which may further be disposed on the coiled tubing. If it is determined in block 450 that maintaining depth control of the BHA is not an operational parameter, then flow chart 400 proceeds to block 460 and the vessel injector is the principal injector during at least part of the coiled tubing operation until the coiled tubing string and/or BHA becomes pipe light and/or precise depth control of the BHA is an operational parameter. If it is determined in block 450 that maintaining depth control of the BHA is an operational parameter, then flow chart 400 proceeds to block 470 and the subsea injector is the principal injector.

As previously described, in some examples, a drive system (e.g., drive motor 213 in FIG. 2) which manipulates the chain loops (e.g., chain loops 207 in FIG. 2) of the agent injector may be at least partially or fully disengaged from the coiled tubing string (e.g., coiled tubing string 115 in FIG. 1). As such, for some examples, the pressure applied on the coiled tubing by the chain loops of the agent injector may be reduced or removed. In some examples, maintaining the pressure on the coiled tubing string with the chains of the principal injector while reducing or removing the pressure of the coiled tubing string from the chains of the agent injector may reduce the amount of wear and/or fatigue on the coiled tubing string. In further examples, the reduction or removal of the pressure from the chains of the agent injector may reduce the energy consumption required to perform the operation. For example, there may be portions of the coiled tubing operation where the surface injector is assigned as the principal injector and the subsea injector is operated with chain loop pressure that is either reduced or removed. In further examples, when the subsea injector is the agent injector the subsea injector may be operated with the chain loops in the open position such that no chain loop pressure is applied by the subsea injector to the coiled tubing.

Flow chart 400, which may be used to determine the principal injector as illustrated in FIG. 4, may be automated or semi-automated using an information handling system (e.g., information handing system 165 in FIG. 1). In some examples, the flow chart of FIG. 4 may be control logic which may further be stored or executed on the information handling system. In some examples, an information handling system may be configured to automatically assign the task of principal injector without the need for human intervention. For example, measurements taken by one or more weights sensors, one or more strain gauges, one or more load cells, one or more encoders, or one or more pressure sensors, and/or any combination thereof may be transmitted to the information handling system. The measurements received by the information handling system may then be utilized and/or applied to flow chart 400 to determine the principal injector based on the description discussed above. Flow chart 400 may be run and/or performed by the information handling system continuously with respect to time, intermittently at random intervals in time, intermittently at set intervals in time, intermittently as changes are detected in the sensors, on demand as requested by personnel, or combinations thereof. In other examples, personnel may oversee which injector is designated as the principal injector. In such an example, personnel may select the principal injector using the information handling system. A selection of the principal injector by personnel may be input into the information handling system, which may then automatically communicate to the injectors which injector is the principal injector.

Accordingly, the present disclosure may provide for methods and systems for performing a riserless subsea coiled tubing operation. The methods and systems may include any of the various features disclosed herein, including one or more of the following statements.

Statement 1. A method comprising: positioning a vessel supporting a coiled tubing string over a subsea wellhead disposed on a wellbore; relaying and landing a distal end of the coiled tubing string to the subsea wellhead using a first injector, wherein relaying the distal end of the coiled tubing string comprises relaying a second injector into a subsea environment to establish a subsea injector, and wherein the first injector is a surface injector disposed on the vessel; connecting a coiled tubing module to a pressure control assembly disposed on the subsea wellhead; using either the first injector or the second injector as a principal injector to extend the coiled tubing string into the wellbore, wherein the principal injector is determined based at least in part on a wellbore pressure; and performing a wellbore operation with the coiled tubing string, wherein the wellbore operation does not utilize a riser.

Statement 2. The method of statement 1, wherein the principal injector controls the location of a bottom hole assembly disposed on the distal end of the coiled tubing string.

Statement 3. The method of statement 1 or 2, further comprising establishing and maintaining a coiled tubing operational parameter or coiled tubing operational parameter envelope, wherein the coiled tubing operational parameter or coiled tubing operational parameter envelope is a tension or range of tensions in the coiled tubing between the first injector and the second injector.

Statement 4. The method of any of the foregoing statements, further comprising establishing and maintaining a coiled tubing operational parameter or coiled tubing operational parameter envelope, wherein the coiled tubing operational parameter or coiled tubing operational parameter envelope is a length or range of lengths of coiled tubing between the first injector and the second injector.

Statement 5. The method of any of the foregoing statements, wherein the first injector or the second injector is the principal injector when the coiled tubing string is disposed in the wellbore and the coiled tubing string is pipe heavy.

Statement 6. The method of any of the foregoing statements, wherein the first injector is the principal injector, and wherein a drive system to chains disposed on the second injector are disengaged to reduce or remove a chain pressure applied by the second injector to the coil tubing string.

Statement 7. The method of any of the foregoing statements, wherein the second injector is the principal injector when the coiled tubing string is disposed in the wellbore and the coiled tubing string is pipe light.

Statement 8. The method of any of the foregoing statements, further comprising an information handling system in communication with the first injector and the second injector, wherein the information handling system selects the principal injector from the first injector, or the second injector based at least in part on the well pressure.

Statement 9. The method of any of the foregoing statements, further comprising removing the distal end of the coiled tubing string from the wellbore, disconnecting the wellhead connection assembly from the subsea wellhead, and utilizing the first injector as the primary injector to retrieve the coiled tubing string.

Statement 10. The method of any of the foregoing statements, wherein the first injector is a hydraulic workover unit or a snubbing unit.

Statement 11. The method of any of the foregoing statements, wherein the first injector is a hydraulic or an electric injector, and wherein the second injector is a hydraulic or an electric injector.

Statement 12. A method comprising: positioning a vessel supporting a coiled tubing string over a subsea wellhead disposed on a wellbore; relaying a distal end of the coiled tubing string to the subsea wellhead using a first injector, wherein the distal end of the coiled tubing string comprises a second injector, and wherein the first injector is disposed on the vessel; connecting a coiled tubing module to a pressure control assembly disposed on the subsea wellhead; establishing and maintaining a coiled tubing operational parameter or coiled tubing operational parameter envelope, wherein the coiled tubing operational parameter or coiled tubing operational parameter envelope is either a length or range of lengths of coiled tubing disposed between the first injector and the second injector or a tension or range of tensions in the coiled tubing between the first injector and the second injector; using either the first injector or the second injector as a principal injector to extend the coiled tubing string into the wellbore, wherein the principal injector is determined based at least in part on a wellbore pressure, and wherein the principal injector controls the location of a bottom hole assembly disposed on the distal end of the coiled tubing string; and performing a wellbore operation.

Statement 13. The method of statement 12, wherein the first injector or the second injector is the principal injector when the coiled tubing string is disposed in the wellbore and the coiled tubing string is pipe heavy.

Statement 14. The method of statements 12 or 13, wherein the first injector is the principal injector, and wherein a drive system to chains disposed on the second injector are disengaged to reduce or remove a chain pressure applied by the second injector to the coil tubing string.

Statement 15. The method of any statements 12 through 14, wherein the second injector is the principal injector when the coiled tubing string is disposed in the wellbore and the coiled tubing string is pipe light.

Statement 16. The method of any statements 12 through 15, further comprising an information handling system in communication with the first injector and the second injector, wherein the information handling system selects the principal injector from the first injector, or the second injector based at least in part on the well pressure.

Statement 17. The method of any statements 12 through 16, wherein the first injector is a hydraulic or an electric injector, and wherein the second injector is a hydraulic or an electric injector.

Statement 18. A system comprising: a vessel; a coiled tubing string disposed on a coiled tubing reel, the coiled tubing string comprising a first end and a second end, wherein the coiled tubing reel is disposed on the vessel, and wherein the first end of the coiled tubing string is extended into a subsea environment; a first injector comprising a first sensor and a drive motor, wherein the drive motor is configured to engage the coiled tubing string to extend or retract the first end of the coiled tubing string relative to the vessel, and wherein the first injector is disposed on the vessel; a second injector comprising a second sensor and a drive motor, wherein the drive motor is configured to engage the coiled tubing string to extend or retract the first end of the coiled tubing string relative to the vessel, and wherein the second injector is not disposed on the vessel; and an information handling system in communication with the first injector and the second injector, wherein the information handling system selects the principal injector from the first injector or the second injector based at least in part on the well pressure.

Statement 19. The system of claim 18, wherein the second injector is the principal injector when the coiled tubing string is disposed in the wellbore and the coiled tubing string is pipe light.

Statement 20. The system of claim 18 or 19, wherein the first injector or the second injector is the principal injector when the coiled tubing string is disposed in the wellbore and the coiled tubing string is pipe heavy, and wherein when the first injector is the principal injector, a drive system to chains disposed on the second injector are disengaged to reduce or remove a chain pressure applied by the second injector to the coil tubing string.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method comprising:

positioning a vessel with a surface injector, supporting a coiled tubing string, over a subsea wellhead disposed on a wellbore;

relaying and landing a subsea injector disposed on a distal end of the coiled tubing string to the subsea wellhead using the surface injector;

connecting a coiled tubing module to a pressure control assembly disposed on the subsea wellhead;

wherein after connecting the coiled tubing module to the pressure control assembly:

making a first determination that either the surface injector or the subsea injector as a principal injector based, at least in part, on a wellbore pressure;

using the principal injector to extend the coiled tubing string into the wellbore; and performing a wellbore operation using the coiled tubing string while maintaining tension in the coiled tubing string between the surface injector and the subsea injector, wherein the wellbore operation does not utilize a riser.

2. The method of claim 1, wherein the principal injector controls a location of a bottom hole assembly disposed on the distal end of the coiled tubing string.

3. The method of claim 1, further comprising establishing and maintaining the tension in the coiled tubing string between the surface injector and the subsea injector.

4. The method of claim 1, further comprising establishing and maintaining a length of the coiled tubing string between the surface injector and the subsea injector.

5. The method of claim 1, wherein the surface injector or the subsea injector is the principal injector when the coiled tubing string is disposed in the wellbore and the coiled tubing string is pipe heavy.

6. The method of claim 5, wherein the surface injector is the principal injector, and wherein a drive system to chains disposed on the subsea injector are disengaged to reduce or remove a chain pressure applied by the subsea injector to the coiled tubing string.

7. The method of claim 1, wherein the subsea injector is the principal injector when the coiled tubing string is disposed in the wellbore and the coiled tubing string is pipe light.

8. The method of claim 1, further comprising an information handling system in communication with the surface injector and the subsea injector, wherein the information handling system selects the principal injector from the surface injector, or the subsea injector based, at least in part, on the well pressure.

9. The method of claim 1, further comprising removing the distal end of the coiled tubing string from the wellbore, disconnecting a pressure control module from the pressure control assembly, and utilizing the surface injector as the principal injector to retrieve the coiled tubing string.

10. The method of claim 1, wherein the surface injector is a hydraulic workover unit or a snubbing unit.

11. The method of claim 1, wherein the surface injector is a hydraulic injector or an electric injector, and wherein the subsea injector is a hydraulic injector or an electric injector.

12. A method comprising:

positioning a vessel with a surface injector, supporting a coiled tubing string, over a subsea wellhead disposed on a wellbore;

relaying a subsea injector disposed on a distal end of the coiled tubing string to the subsea wellhead using the surface injector;

connecting a coiled tubing module to a pressure control assembly disposed on the subsea wellhead; and performing a wellbore operation after connecting the coiled tubing module to the pressure control assembly, wherein during the wellbore operation, the method further comprises:

establishing and maintaining tension in the coiled tubing string between the surface injector and the subsea injector;

making a first determination that either the surface injector or the subsea injector as a principal injector based, at least in part, on a wellbore pressure; and using the principal injector to extend the coiled tubing string into the wellbore wherein the principal injector controls a location of a bottom hole assembly disposed on the distal end of the coiled tubing string.

13. The method of claim 12, wherein the surface injector or the subsea injector is the principal injector when the coiled tubing string is disposed in the wellbore and the coiled tubing string is pipe heavy.

14. The method of claim 13, wherein the surface injector is the principal injector, and wherein a drive system to chains disposed on the see-end-subsea injector are disengaged to reduce or remove a chain pressure applied by the subsea injector to the coiled tubing string.

15. The method of claim 12, wherein the subsea injector is the principal injector when the coiled tubing string is disposed in the wellbore and the coiled tubing string is pipe light.

16. The method of claim 12, further comprising an information handling system in communication with the surface injector and the subsea injector, wherein the information handling system selects the principal injector from the surface injector, or the subsea injector based at least in part on the well pressure.

17. The method of claim 12, wherein the surface injector is a hydraulic injector or an electric injector, and wherein the subsea injector is a hydraulic injector or an electric injector.

18. A system comprising:

a vessel above a subsea environment;

a coiled tubing reel disposed on the vessel;

a coiled tubing string at least partially disposed on the coiled tubing and at least partially extended into the subsea environment;

a surface injector, disposed on the vessel, comprising a first sensor and a first drive motor, wherein the first drive motor is configured to engage the coiled tubing string to extend or retract the coiled tubing string relative to the vessel;

a subsea injector, not disposed on the vessel, comprising a second sensor and a second drive motor, wherein the second drive motor is configured to engage the coiled tubing string to extend or retract the coiled tubing string relative to the vessel; and an information handling system in communication with the surface injector and the subsea injector, wherein the information handling system selects a principal injector from the surface injector or the subsea injector based, at least in part, on a well pressure, wherein tension is maintained on the coiled tubing string between the surface injector and the subsea injector while a wellbore operation is performed using the coiled tubing string.

19. The system of claim 18, wherein the subsea injector is the principal injector when the coiled tubing string is disposed in a wellbore and the coiled tubing string is pipe light.

20. The system of claim 18, wherein the surface injector or the subsea injector is the principal injector when the coiled tubing string is disposed in a wellbore and the coiled tubing string is pipe heavy, and wherein when the surface injector is the principal injector, a drive system to chains disposed on the subsea injector are disengaged to reduce or remove a chain pressure applied by the subsea injector to the coiled tubing string.

* * * * *